US006036041A

United States Patent [19]

Chern

[11] Patent Number: 6,036,041

[45] Date of Patent: Mar. 14, 2000

[54] FOLDABLE VOTING BOX

[76] Inventor: Ruey Chyuan Chern, P.O. Box 63-99, Taichung, 406, Taiwan

[21] Appl. No.: 09/244,660

[22] Filed: Feb. 4, 1999

[51] Int. Cl.[7] ..... B65D 6/22

[52] U.S. Cl. ..... 220/6; 220/7; 220/4.33; 232/2

[58] Field of Search ..... 232/2, 3, 43.1; 220/6, 7, 4.28, 259, 256, 666, 4.33, 817, 818, 819, 826

[56] References Cited

U.S. PATENT DOCUMENTS

| | | | |
|---|---|---|---|
| 300,512 | 6/1884 | Ringo et al. | 232/2 |
| 1,673,769 | 6/1928 | Graham | 232/2 |
| 3,806,219 | 4/1974 | Ahmann | 312/265 |
| 4,699,312 | 10/1987 | Owen | 232/2 |
| 5,072,999 | 12/1991 | Trotta et al. | 312/249.8 |
| 5,251,772 | 10/1993 | Toguchi | 220/6 |
| 5,275,365 | 1/1994 | Gerbel et al. | 248/129 |
| 5,429,261 | 7/1995 | Machino | 220/7 |
| 5,560,508 | 10/1996 | Hsu | 220/4.31 |
| 5,620,108 | 4/1997 | Hsu | 220/4.34 |

*Primary Examiner*—Stephen Castellano

[57] ABSTRACT

A box includes a base having an upward extending peripheral fence, a pair of side panels each having a lower portion pivotally coupled to the base, a front panel and a rear panel detachably secured to the base and the side panels. A frame is engaged on top of the panels. A cap and a cover are pivotally coupled to the frame. The cap has one or more openings for voting purposes. The panels may be engaged in the frame and engaged between the base and the cover for forming a compact folding structure that is excellent for storing and transportation purposes.

7 Claims, 7 Drawing Sheets

FOLDABLE VOTING BOX

BACKGROUND OF THE INVENTION

1. Field of the Invention

The present invention relates to a box, and more particularly to a foldable voting box.

2. Description of the Prior Art

Typical boxes for voting purposes comprise a box body and a cover pivotally coupled to the upper portion of the box body for enclosing the open upper portion of the box body. However, the box body may not be folded and will occupy a huge volume that is not good for storing and transportation purposes.

The present invention has arisen to mitigate and/or obviate the afore-described disadvantages of the conventional voting boxes.

SUMMARY OF THE INVENTION

The primary objective of the present invention is to provide a voting box which may be folded to a compact configuration that is excellent for storing and transportation purposes.

In accordance with one aspect of the invention, there is provided a box comprising a base including a peripheral portion having a peripheral fence extended upward therefrom, a pair of side panels each including an upper portion and each including a lower portion pivotally coupled to the base for allowing the side panels to be folded to engage with the base, a front panel and a rear panel each including a lower portion detachably secured to the base and each including an upper portion, means for securing the front panel and the rear panel to the side panels, a frame engaged on the upper portions of the side panels and the front and the rear panels, a cap pivotally coupled to the frame and including at least one opening formed therein, and a cover pivotally coupled to the frame. The side panels and the front and the rear panels are engaged in the frame and engaged between the base and the cover for forming a compact folding structure when the front and the rear panels are disengaged from the side panels and the base.

The lower portions of the front and the rear panels each includes a fastener loosely engaged therein for threaded with the base and for securing the front and the rear panels to the base.

The front and the rear panels each includes a middle portion, and securing means is provided for securing the middle portions of the front and the rear panels to the side panels. The side panels each includes a middle portion, the securing means includes a pair of lock devices secured to the middle portion of each of the front and the rear panels, the lock devices each includes a bracket secured to the middle portion of the front and the rear panels and each includes a fastener loosely engaged with the bracket, and means for biasing the fasteners away from the side panels, the fasteners may be forced to engage with the side panels by depressing against the biasing means. The side panels each includes a beam secured to the middle portion thereof and each includes two reinforcing members engaged in the beam for engaging with the fasteners.

The frame includes four bars, and four couplers each having an extension engaged into the bars, and means for securing the extension of the couplers to the bars for forming the frame. The bars each includes two ends each having a puncture formed therein, the extensions of the couplers each includes a latch for engaging with the puncture of the bars and for securing the couplers to the bars.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
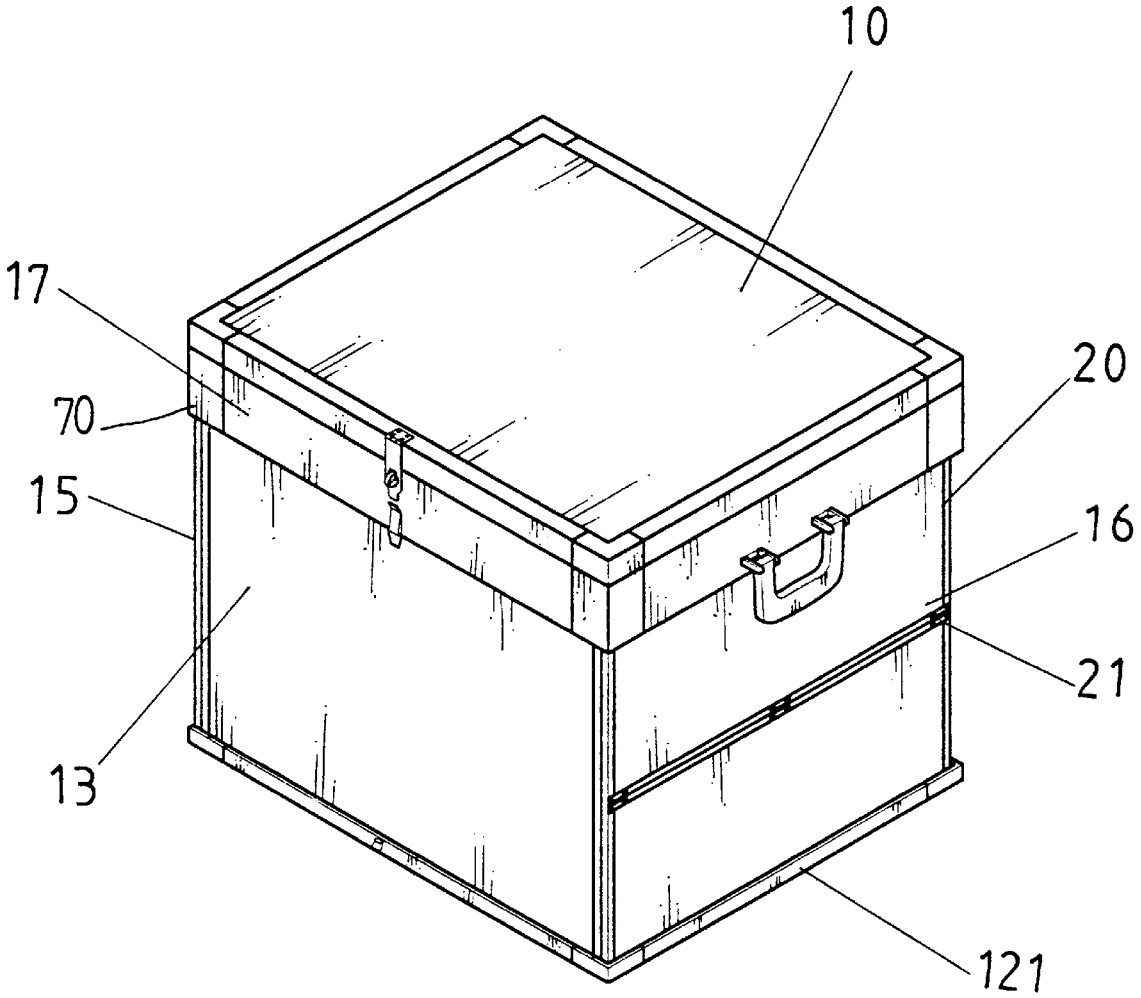
FIG. 1 is a perspective view of a box in accordance with the present invention.

Referring to the drawings, and initially to FIGS. 1–4, a box in accordance with the present invention is particularly provided for voting purposes and comprises a cover 10, a base 12, a front panel 13, a rear panel 14, two side panels 15, 16 and a cap 11 each preferably made of wavy paper boards and each preferably including a peripheral casing 20 engaged on the peripheral portion thereof for reinforcing purposes. The casings 20 may be made of harder materials, such as plastic or metal or aluminum materials. The base 12 includes a peripheral fence 121 extended upward from the peripheral portion thereof and having two holes or screw holes 122, 123 formed in the front and the rear portions thereof. The side panels 15, 16 each includes a lower portion pivotally coupled to the base 12 by pivot pins or hinges 21 for allowing the side panels 15, 16 to be folded to engage with the base 12. The side panels 15, 16 each includes a beam 62 secured to the middle portion thereof and having two holes or screw holes 60 formed in the side portions thereof.

Figure 3:
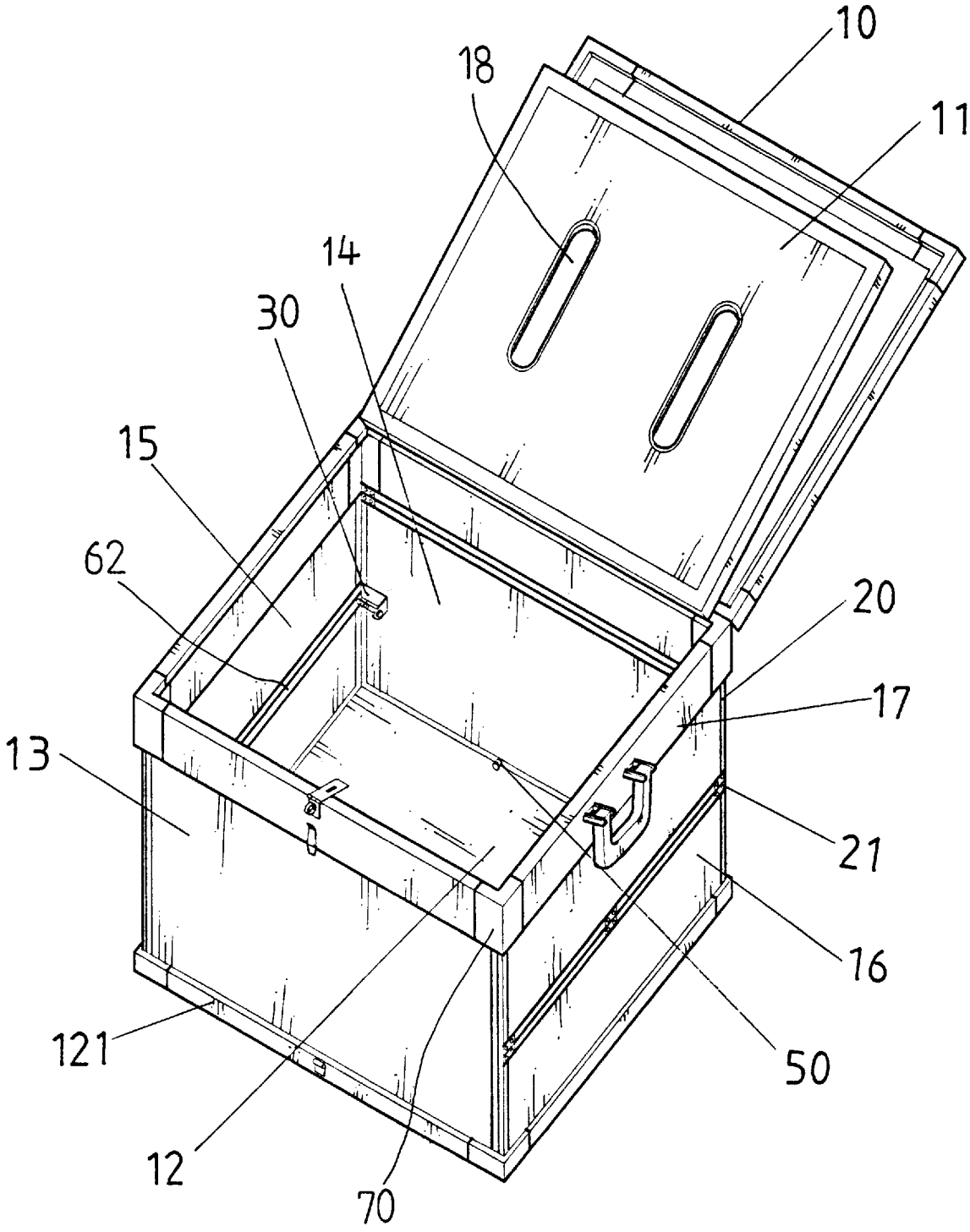
Figure 4:
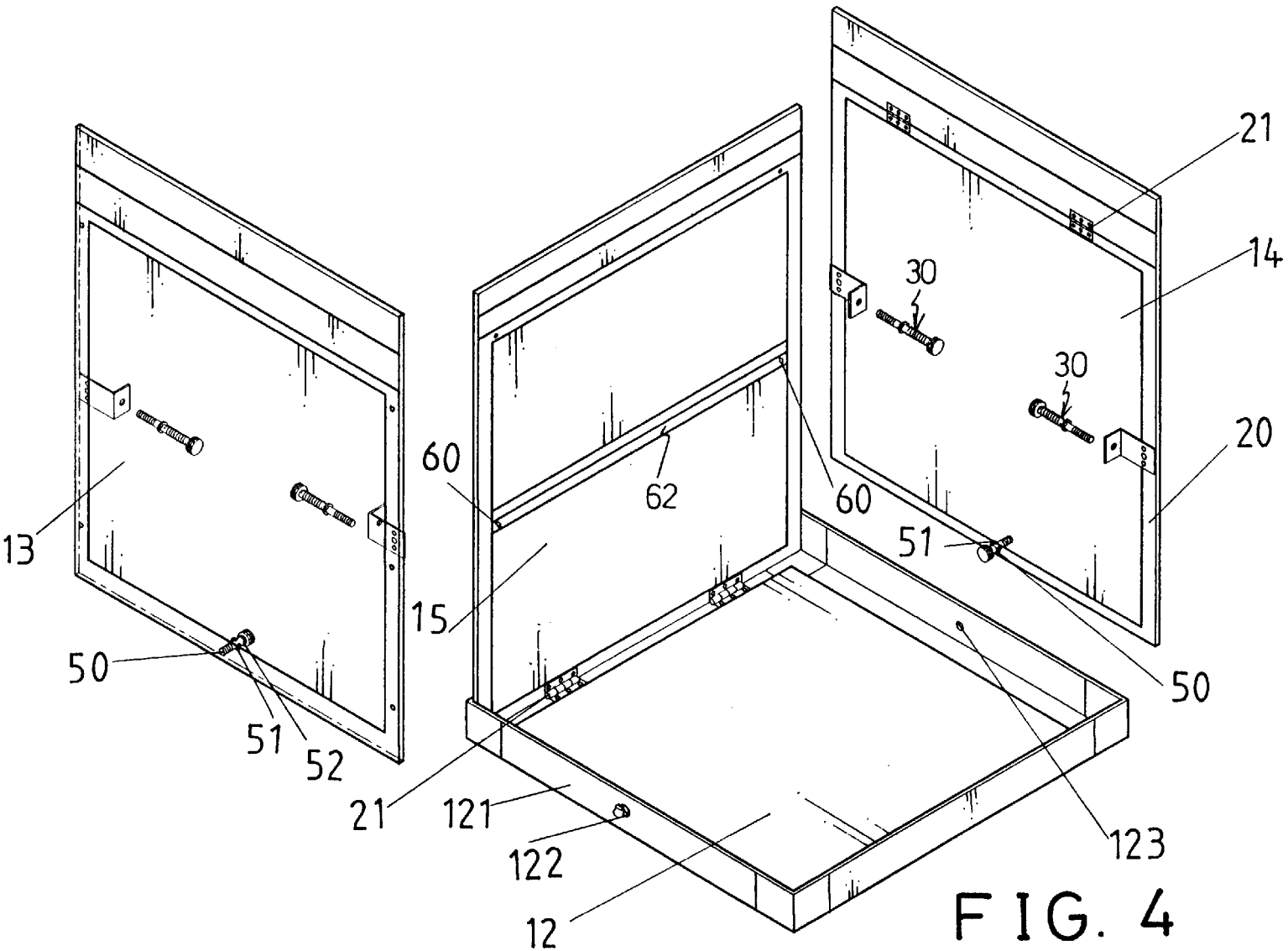
FIG. 4 is an exploded view of the box.
Figure 5:
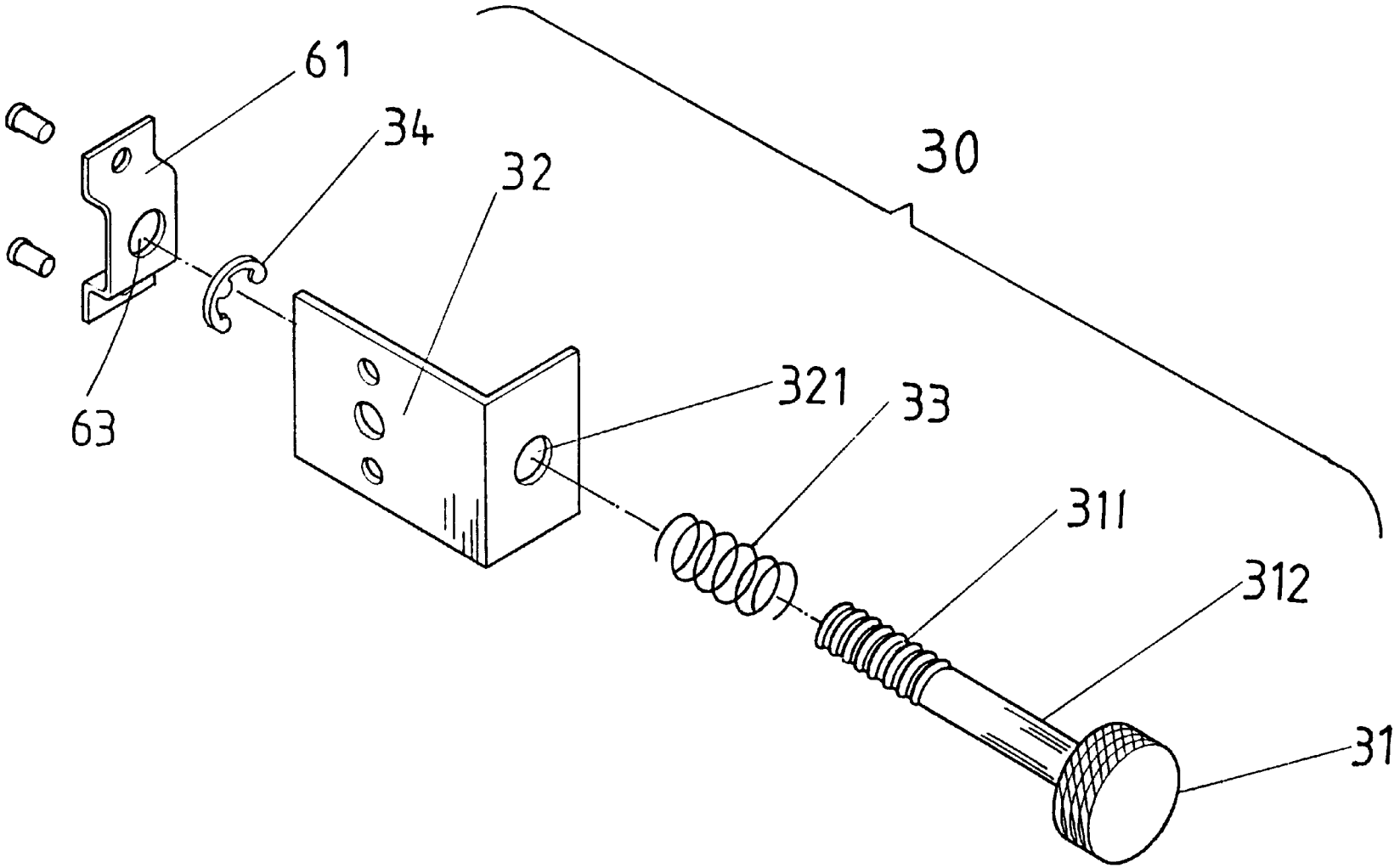
FIGS. 5, 6, 7 are partial exploded views illustrating fastener devices of box.
Figure 6:
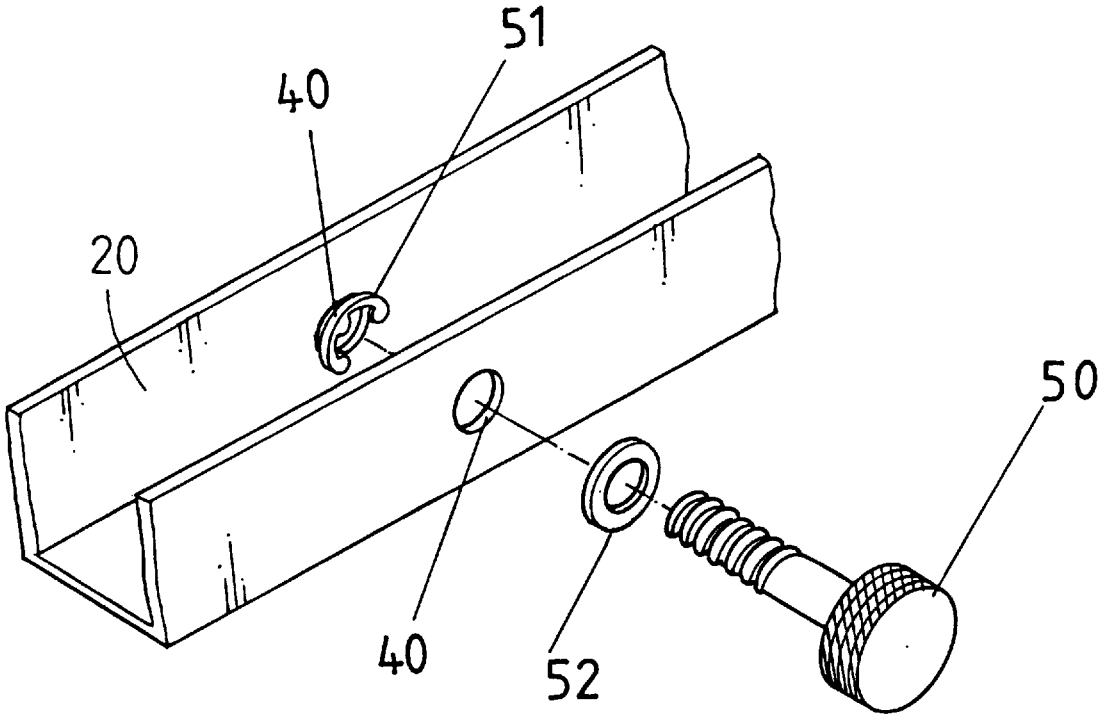

The front and the rear panels 13, 14 each includes a fastener 50 threaded through a hole 40 (FIG. 6) that is formed in the bottom portion of the panels 13, 14. A ring 52 and a clamping ring 51 (FIG. 6) are engaged with the fastener 50 for loosely securing the fastener 50 to the respective panels 13, 14. The fasteners 50 of the front and the rear panels 13, 14 are threaded to the screw holes 122, 123 of the base 12 for securing the bottom portions of the panels 13, 14 to the base 12 (FIG. 3). The front and the rear panels 13, 14 each includes two lock devices 30 (FIGS. 3–5) secured to the middle portion thereof. The lock devices 30 each includes a bracket 32 secured to the panels 13, 14 and having an orifice 321 formed therein for receiving the shank portion 312 of a fastener 31. A clamping ring 34 is engaged with the fastener 31 for loosely securing the fastener 31 to the bracket 32. The beams 62 of the side panels 15, 16 each includes two reinforcing members 61 engaged in the ends thereof for reinforcing purposes and having a hole 63 aligned with the holes or screw holes 60 of the beams 62. The fasteners 31 each includes a threaded portion 311 for engaging with the (screw) holes 63 of the reinforcing members 61 or with the screw holes 60 of the beams 62 and for securing the panels 13–16 in place. A spring 33 is engaged between the fastener 31 and the bracket 32 for biasing the threaded portion 311 of the fastener 31 from the side panels 15, 16 and for allowing the fasteners 31 to be forced to engage with the side panels 15, 16 against the spring 33.

Figure 2:
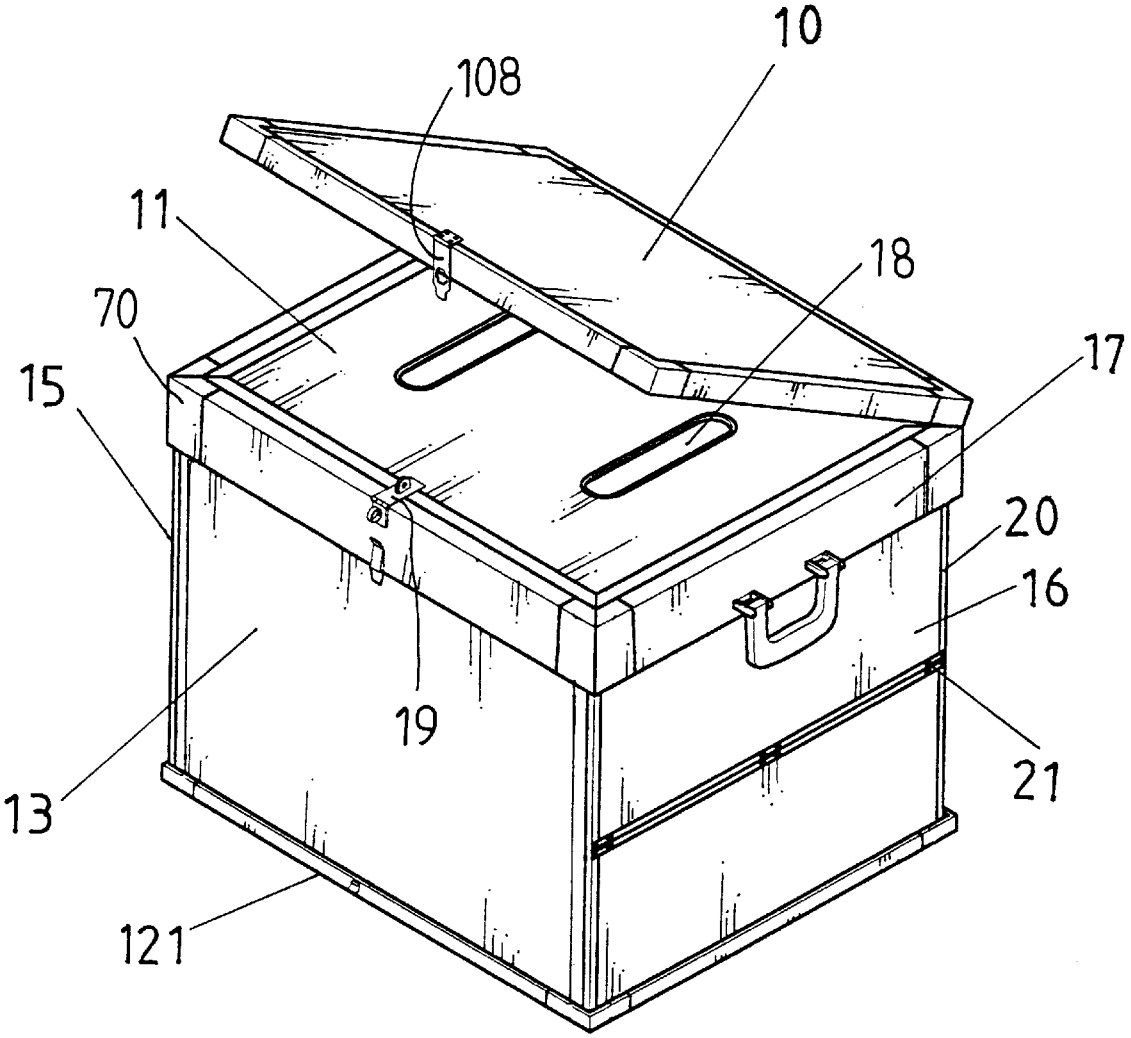
FIGS. 2 and 3 are perspective views illustrating the operation of box.
Figure 8:
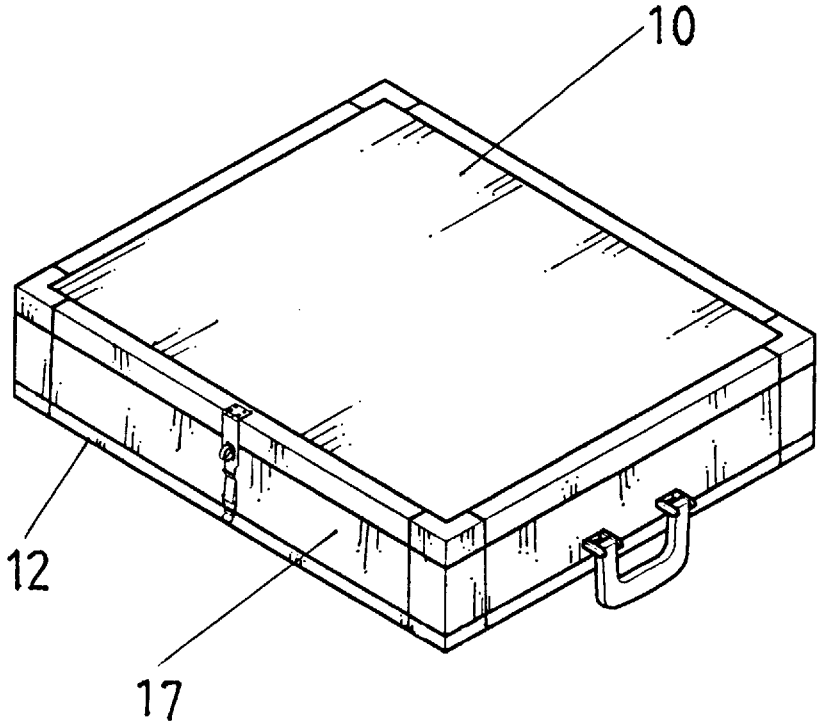
FIG. 8 is a perspective view illustrating the folding structure of the box.

The cap 11 is pivotally coupled to the upper portion of the frame 17 or of the rear panel 14 and includes one or more openings 18 for voting purposes and may be secured in place by a lock device 19 (FIG. 2). The cover 10 is also pivotally coupled to the upper portion of the rear panel 14 or pivotally coupled to the frame 17 and foldable to engage with the cap 11 and may be opened (FIG. 2) for voting purposes. The cover 10 may be secured to the front panel 13 by a lock device 108. As shown in FIG. 8, when the panels 13–16 are engaged in the frame 17 and engaged between the cover 10 and the base 12, the box may be folded and stored in a compact configuration. The pivotal coupling of one of the side panels 15, 16 is located higher than that of the other side panel, for allowing the side panels 15, 16 to be superposed with each other.

Figure 7:
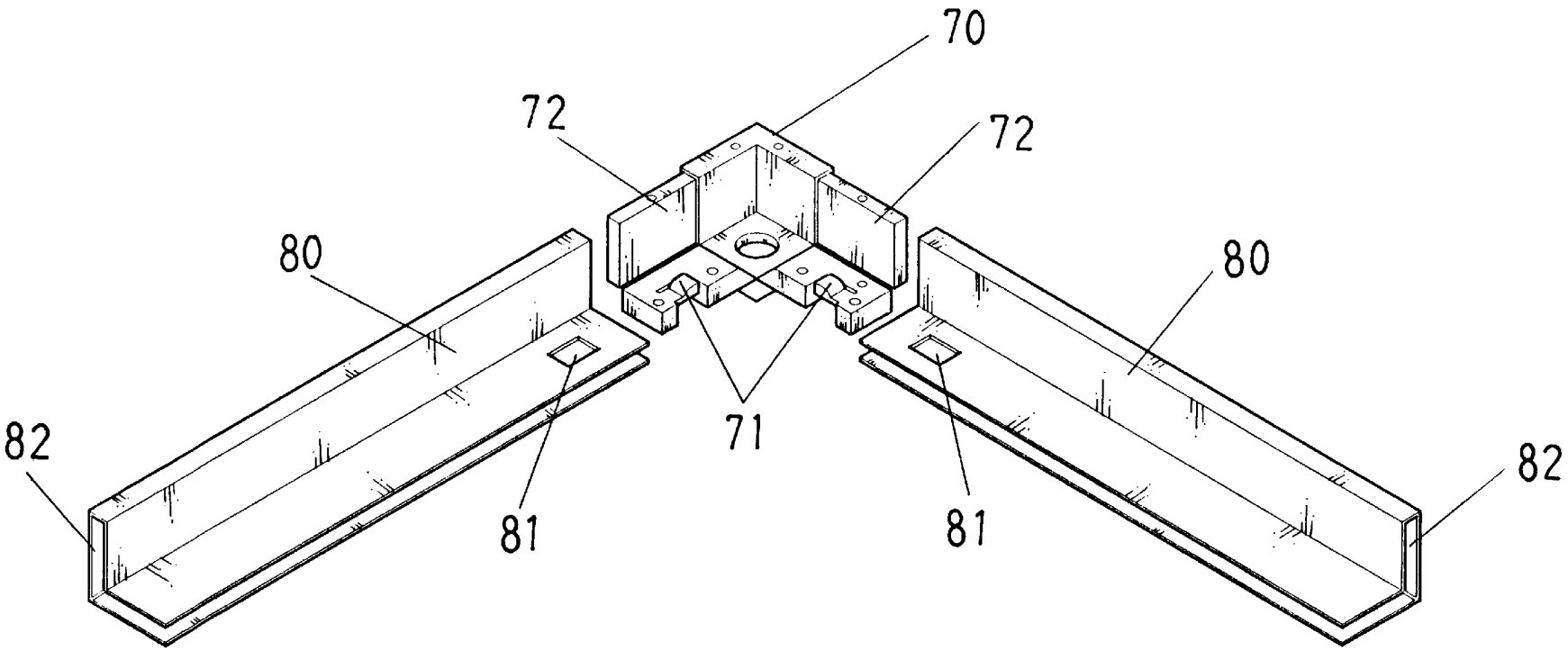

Referring next to FIG. 7 and again to FIGS. 1–4, the frame 17 and/or the peripheral fence 121 of the base 12 each preferably includes four bars 80 each having an L-shaped channel 82 formed therein and each having a puncture 81 formed in the end portion. Four corner couplers 70 each includes an L-shaped extension 72 engaged into the channels 82 of the bars 80 and each includes a latch 71 for engaging with the punctures 81 of the bars 80 for securing the bars 80 together and for forming the frame 17 and/or the peripheral fence 121 of the base 12. The peripheral casings 20 of the panels 13–16 and of the cover 10 and the cap 11 may also be formed by the bars 80 and the couplers 70.

Accordingly, the voting box in accordance with the present invention may be folded to a compact configuration that is excellent for storing and transportation purposes.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A box comprising:

a base including a peripheral portion having a peripheral fence extended upward therefrom, a pair of side panels each including an upper portion and each including a lower portion pivotally coupled to the base for allowing the side panels to be folded to engage with the base, a front panel and a rear panel each including a lower portion detachably secured to said base and each including an upper portion, means for securing said front panel and said rear panel to said side panels, a frame engaged on said upper portions of said side panels and said front and said rear panels, a cap pivotally coupled to said frame and including at least one opening formed therein, and a cover pivotally coupled to said frame, said side panels and said front and said rear panels being engaged in said frame and engaged between said base and said cover for forming a compact folding structure when said front and said rear panels are disengaged from said side panels and said base.

2. The box according to claim 1, wherein said lower portions of said front and said rear panels each includes a fastener loosely engaged therein for threaded with said base and for securing said front and said rear panels to said base.

3. The box according to claim 1, wherein said front and said rear panels each includes a middle portion, and securing means is provided for securing said middle portions of said front and said rear panels to said side panels.

4. The box according to claim 3, wherein said side panels each includes a middle portion, said securing means includes a pair of lock devices secured to said middle portion of each of said front and said rear panels, said lock devices each includes a bracket secured to said middle portion of said front and said rear panels and each includes a fastener loosely engaged with said bracket, and means for biasing said fasteners away from said side panels, said fasteners may be forced to engage with said side panels by depressing against said biasing means.

5. The box according to claim 4, wherein said side panels each includes a beam secured to said middle portion thereof and each includes two reinforcing members engaged in said beam for engaging with said fasteners.

6. The box according to claim 1, wherein said frame includes four bars, and four couplers each having an extension engaged into said bars, and means for securing said extension of said couplers to said bars for forming said frame.

7. The box according to claim 6, wherein said bars each includes two ends each having a puncture formed therein, said extensions of said couplers each includes a latch for engaging with said puncture of said bars and for securing said couplers to said bars.

* * * * *